US008979192B2

(12) United States Patent
Miller

(10) Patent No.: US 8,979,192 B2
(45) Date of Patent: Mar. 17, 2015

(54) PORTABLE COLLAPSIBLE CAMP CHAIR WITH HEATED SEAT AND BACK

(76) Inventor: Timothy R. Miller, Spicewood, TX (US)

( * ) Notice: Subject to any disclaimer, the term of this patent is extended or adjusted under 35 U.S.C. 154(b) by 560 days.

(21) Appl. No.: 13/324,704

(22) Filed: Dec. 13, 2011

(65) Prior Publication Data

US 2012/0313405 A1 Dec. 13, 2012

Related U.S. Application Data

(63) Continuation-in-part of application No. 12/535,915, filed on Aug. 5, 2009, now abandoned.

(60) Provisional application No. 61/086,370, filed on Aug. 5, 2008.

(51) Int. Cl.
*A47C 7/62* (2006.01)
*A47C 7/74* (2006.01)
*A47C 4/28* (2006.01)

(52) U.S. Cl.
CPC ..... *A47C 7/748* (2013.01); *A47C 4/286* (2013.01)
USPC ..... 297/180.12

(58) Field of Classification Search
CPC ..... A47C 3/16; A47C 7/66; A47C 7/72; A47C 7/748; A47C 4/52
USPC ..... 297/4, 17, 180.1, 180.11, 180.12
See application file for complete search history.

(56) References Cited

U.S. PATENT DOCUMENTS 2,705,325 A * 4/1955 Bogenberger ..... 2/69
2,740,466 A * 4/1956 Du Priest ..... 297/183.5
3,427,431 A * 2/1969 Costanzo ..... 219/212
3,500,014 A * 3/1970 Longo ..... 219/211
3,580,633 A * 5/1971 Du Priest ..... 297/184.1
3,597,764 A * 8/1971 Povey ..... 2/69.5
3,621,192 A * 11/1971 Pohler ..... 219/217
4,279,255 A * 7/1981 Hoffman ..... 607/112
4,413,857 A 11/1983 Hayashi
4,942,948 A * 7/1990 Vickers ..... 190/8
5,034,594 A * 7/1991 Beezhold et al. ..... 219/528
5,067,771 A * 11/1991 Ellis ..... 297/378.1
D329,248 S * 9/1992 Brown ..... D6/333
5,259,379 A 11/1993 Kim et al.
5,283,909 A * 2/1994 Hill ..... 2/69
5,489,142 A 2/1996 Mathieu
5,516,189 A * 5/1996 Ligeras ..... 297/180.11

(Continued)

FOREIGN PATENT DOCUMENTS

DE 19511753 10/1996
DE 10123654 7/2002

*Primary Examiner* — Laurie Cranmer

(74) *Attorney, Agent, or Firm* — Fellers, Snider, Blankenship, Bailey & Tippens, P.C.

(57) ABSTRACT

A heated portable collapsible chair includes a collapsible frame. The collapsible frame supports a fabric human contact sheet having a chair seat portion and a chair back portion. A flexible heating element is located adjacent to a back surface of the human contact sheet so that heat generated by the heating element passes through the human contact sheet to warm a user. A battery is provided for selectively heating the heating element. The flexible heating element is preferably affixed to a backing sheet wherein the backing sheet is affixed to the back surface of the human contact sheet. The flexible heating element accommodates the flexing of the human contact sheet when the human contact sheet is distorted when collapsing the chair for storage or transport.

7 Claims, 7 Drawing Sheets

(56) References Cited

U.S. PATENT DOCUMENTS

| | | | | |
|---|---|---|---|---|
| 5,545,198 | A * | 8/1996 | Owens | 607/108 |
| 5,588,696 | A * | 12/1996 | Jay et al. | 297/129 |
| 5,611,082 | A * | 3/1997 | Bull | 2/79 |
| 5,611,095 | A | 3/1997 | Schneider | |
| 5,623,919 | A | 4/1997 | Kelly | |
| 5,697,963 | A | 12/1997 | Augustine | |
| 5,779,112 | A * | 7/1998 | Krulik | 224/155 |
| 5,785,219 | A * | 7/1998 | Kraft | 224/576 |
| 6,073,998 | A * | 6/2000 | Siarkowski et al. | 297/180.12 |
| 6,127,655 | A * | 10/2000 | Humes et al. | 219/217 |
| 6,164,726 | A | 12/2000 | Reeves et al. | |
| 6,220,659 | B1 * | 4/2001 | McDowell et al. | 297/180.12 |
| 6,223,367 | B1 * | 5/2001 | French et al. | 5/419 |
| 6,311,330 | B1 * | 11/2001 | Rothman | 2/69 |
| 6,382,715 | B1 | 5/2002 | Tang | |
| 6,531,687 | B2 | 3/2003 | Michelmann | |
| 6,657,170 | B2 | 12/2003 | Clothier | |
| 6,686,562 | B1 | 2/2004 | Weiss et al. | |
| 6,764,134 | B1 | 7/2004 | Crescenzi et al. | |
| 6,792,671 | B1 | 9/2004 | Oberg | |
| 6,817,446 | B1 | 11/2004 | Bisland | |
| 6,848,746 | B2 * | 2/2005 | Gentry | 297/380 |
| 6,914,217 | B2 | 7/2005 | Fristedt | |
| 7,036,153 | B2 * | 5/2006 | Gibson et al. | 2/69 |
| 7,090,297 | B2 | 8/2006 | Mohn et al. | |
| RE39,394 | E | 11/2006 | Suzuki et al. | |
| 7,131,187 | B2 | 11/2006 | Check et al. | |
| 7,134,715 | B1 | 11/2006 | Fristedt et al. | |
| 7,178,866 | B1 | 2/2007 | Scott | |
| 7,202,444 | B2 | 4/2007 | Bulgajewski | |
| 7,240,962 | B2 | 7/2007 | Kim | |
| 7,244,914 | B2 | 7/2007 | Yoneyama et al. | |
| 7,250,586 | B2 | 7/2007 | Diemer et al. | |
| 7,306,283 | B2 | 12/2007 | Howick et al. | |
| 7,370,911 | B2 | 5/2008 | Bajic et al. | |
| 7,422,277 | B2 | 9/2008 | Chen | |
| 7,438,356 | B2 * | 10/2008 | Howman et al. | 297/180.11 |
| 7,500,536 | B2 | 3/2009 | Bulgajewski et al. | |
| 7,506,927 | B1 | 3/2009 | Williams | |
| 7,581,259 | B2 | 9/2009 | Thompson | |
| 7,802,844 | B1 * | 9/2010 | Vencill | 297/184.14 |
| 7,857,378 | B2 * | 12/2010 | Smith | 297/16.2 |
| 7,866,743 | B1 * | 1/2011 | Russell et al. | 297/180.12 |
| 8,186,755 | B2 * | 5/2012 | Lovley | 297/184.15 |
| 2003/0034674 | A1 * | 2/2003 | Gibson et al. | 297/4 |
| 2004/0195227 | A1 * | 10/2004 | Park | 219/217 |
| 2004/0217633 | A1 | 11/2004 | Kassai et al. | |
| 2006/0049672 | A1 * | 3/2006 | Terrell | 297/17 |
| 2007/0013213 | A1 | 1/2007 | Axinte et al. | |
| 2007/0108248 | A1 * | 5/2007 | Hoffmeier et al. | 224/650 |
| 2007/0152479 | A1 | 7/2007 | Howman et al. | |
| 2008/0001449 | A1 | 1/2008 | Moon | |
| 2009/0072594 | A1 * | 3/2009 | Korytowski | 297/180.12 |

* cited by examiner

PORTABLE COLLAPSIBLE CAMP CHAIR WITH HEATED SEAT AND BACK

CROSS REFERENCE TO RELATED APPLICATIONS

This application is a continuation-in-part of U.S. patent application Ser. No. 12/535,915, entitled "PORTABLE COLLAPSIBLE CAMP CHAIR WITH HEATED SEAT AND BACK", filed Aug. 5, 2009, which claims the priority of U.S. Provisional Patent Application No. 61/086,370, entitled "PORTABLE COLLAPSIBLE CAMP CHAIR WITH HEATED SEAT AND BACK," filed Aug. 5, 2008, the contents of both of which are hereby incorporated by reference.

FIELD OF THE INVENTION

The invention relates to portable, collapsible camping chairs and more particularly to collapsible chairs with heated seats and backs.

BACKGROUND OF THE INVENTION

Portable, collapsible chairs that can be rolled up for easy storage and transport are well known. Chairs of this type are shown, for example, in U.S. Pat. Nos. 6,164,726 to Reeves et al., 6,755,462 to Zheng, and 6,382,715 to Tang.

A conventional collapsible chair comprises a foldable chair frame constructed by metal tubes and a seat fabric. The foldable chair frame comprises a plurality of construction tubes to construct a back frame and a seat frame for supporting the fabric seat. The fabric seat of the conventional collapsible chair is preferably made of durable fabric, such as twilled nylon or other mixing material such as polyurethane.

Because conventional collapsible chairs can be quickly and easily unfolded for use and folded into a compact fold-up structure for transport, the user can carry the collapsible chairs to all kinds of outdoor activities, such as camping and sporting events. However, conventional collapsible chairs are not ideal for winter use because the nylon material of the fabric seats does not accumulate heat so that the user has to tolerate the cold air on his backside. Even though the body temperature of the user may warm up the upper contacting surface of the fabric seat, the bottom surface immediately wicks away the body heat to the cold environment below.

Folding stadium seats are also well known, and some even incorporate a heating element for warming the user's back and seat. For example, U.S. Pat. Nos. 6,007,572 to Baldwin and 6,848,746 to Gentry disclose folding stadium seats with heating elements. However, these types of seats are uncomfortable and are typically used on the bench seating typical of sports stadiums. Folding stadium seats are not practical or comfortable for use while camping or watching outdoor events where no stadium seating is provided.

What is needed is a stand-alone, collapsible, portable chair that warms the user's body and is comfortable and easy to transport.

SUMMARY OF THE INVENTION

A main object of the present invention is to provide a portable, collapsible chair that includes a heating element in the seat and back that keeps a user warm when using the chair outside, particularly during the winter.

The heated portable collapsible chair includes a frame having four legs, a chair back support, and a pair of arm members. A fabric human contact sheet has a seat portion and a chair back portion. The fabric human contact sheet is typically provided with a plurality of orifices for receiving portions of the frame. Fabric armrests may also be provided.

A fabric backing portion is provided with fabric receptacles for receiving upper ends of the chair back support. The fabric backing portion is affixed to and is adjacent to the seat portion and the chair back portion of the fabric human contact sheet.

A heating pad is secured to a back or under surface of the human contact sheet. The heating pad includes a fabric backing sheet and heating elements. For purposes of this invention, both the fabric backing sheet and the heating elements are flexible to facilitate the collapsing of the chair, in particular the collapse of the human contact sheet when the chair is configured for storage. Heat generated by the heating elements passes through the human contact sheet to warm a user.

A fabric chair backing portion provides an attractive cover so that the heating pad is not visible. A battery enclosing compartment is affixed to the fabric chair backing portion at a location that is adjacent to the chair back portion of the human contact sheet. A battery is located in the battery enclosing compartment. The battery is in electrical communication with the heating element of the heating pad. A heat activation switch, preferably provided on the battery, is in electrical communication with the heating element.

DETAILED DESCRIPTION OF THE PREFERRED EMBODIMENTS

Figure 1:
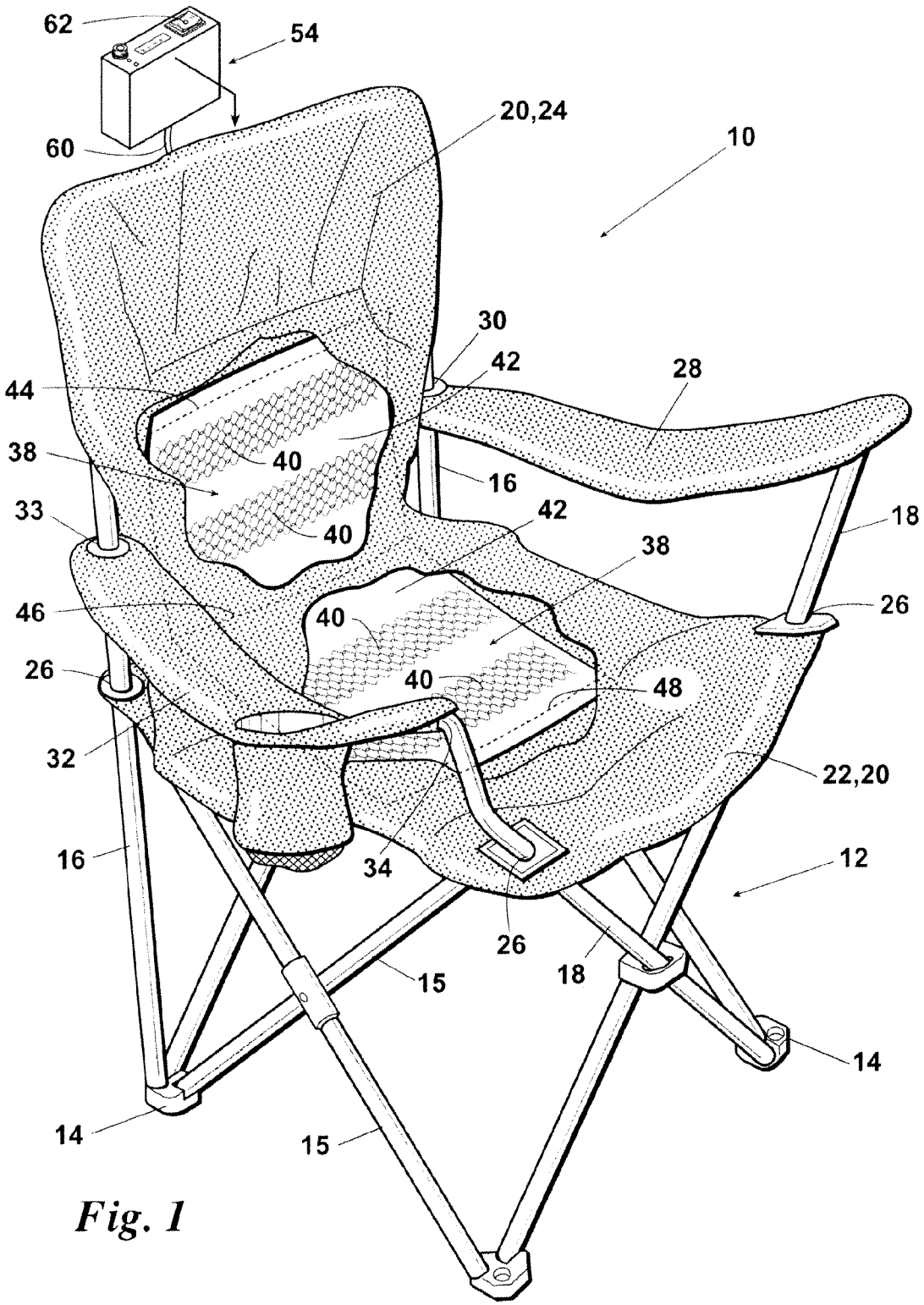
FIG. 1 is a perspective view of a fully assembled portable collapsible chair of the invention with broken away portions to reveal heating pads.

The present invention discloses a portable, collapsible camping chair that has a heated seat and back. The chair has a self-contained rechargeable electrical power source, such as a battery, for operating an electrical heating element. The heating element is made from a flexible material so that the chair can be folded and collapsed into a compact configuration for locating in a cylindrical bag for storage and transport. An external charger is used to charge the batteries prior to use so that the portable camping chair can be used in locations not accessible by electrical power. The chair includes a power switch that controls the heating element so the operator has the option of off, low or high temperature for their comfort. The battery may be located in an attached pouch that is water resistant.

The battery will preferably provide heat for 3 to 6 hours depending on the setting of the chair and the outside temperature. In one embodiment, the chair has the capability of being plugged directly into an electrical outlet. The battery may also have the capability of being charged from a car charger.

Referring now to the figures, shown is a heated, portable, collapsible chair designated generally 10. Heated chair 10 includes a frame, designated generally 12. Frame 12 includes four feet 14 connected to interconnected collapsible frame members 15. Rear legs 16 form a chair back support. Front members 18 form a pair of arm supports.

A fabric human contact sheet is designated generally 20. Fabric human contact sheet 20 is made up of seat portion 22 and chair back portion 24. Seat portion 22 of fabric human contact sheet 20 includes a plurality of orifices 26 for receiving portions of frame 12.

Left arm rest 28 is provided with rear orifice 30 for receiving one of rear legs 16 and is provided with front orifice 31 for receiving one of front members 18. A right arm rest 32 is provided with a rear orifice 33 for receiving one of rear legs 16 and is provided with a front orifice 34 for receiving one of front members 18.

Fabric chair backing portion 35 (FIGS. 3, 4) has back support receptacles 36 (FIG. 4) affixed thereto for receiving upper ends of chair back support 16 of frame 12. Fabric chair backing portion 35 is adjacent to seat portion 22 and chair back portion 24 of fabric human contact sheet 20 and is preferably sewn together with fabric human contact sheet 20. Although a single fabric chair backing portion 35 is shown, other configurations, including a chair back segment and separate chair seat segment could also be utilized.

A heating pad is designated generally 38. Heating pad 38 includes heating elements 40 that are secured to a backing sheet 42. Heating elements 40 are preferably constructed of 1 k carbon fiber, although other materials may also be used. Heating element 40 must be flexible to accommodate the collapsing of human contact sheet 20 when the chair is reconfigured from a use configuration to a collapsed or storage configuration. In particular, heating pad 38, with attached heating elements 40 should be sufficiently flexible to fold onto itself, i.e., to touch opposite edges, to ensure that heating pad 38 is sufficiently compact not to impede collapsing of chair 10. Backing sheet 42 is preferably constructed of a flexible, non-flammable non-woven material, although other materials may also be used. Backing sheet 42 (FIGS. 1, 2) is affixed to a back or under side of human contact sheet 20, i.e. backing sheet 42 is affixed to a surface of human contact sheet 20 that faces away from a seated user. Backing sheet 42 is affixed to seat portion 22 and chair back portion 24, preferably via an upper stitch 44, a middle stitch 46, and a lower stitch 48.

Figure 6:
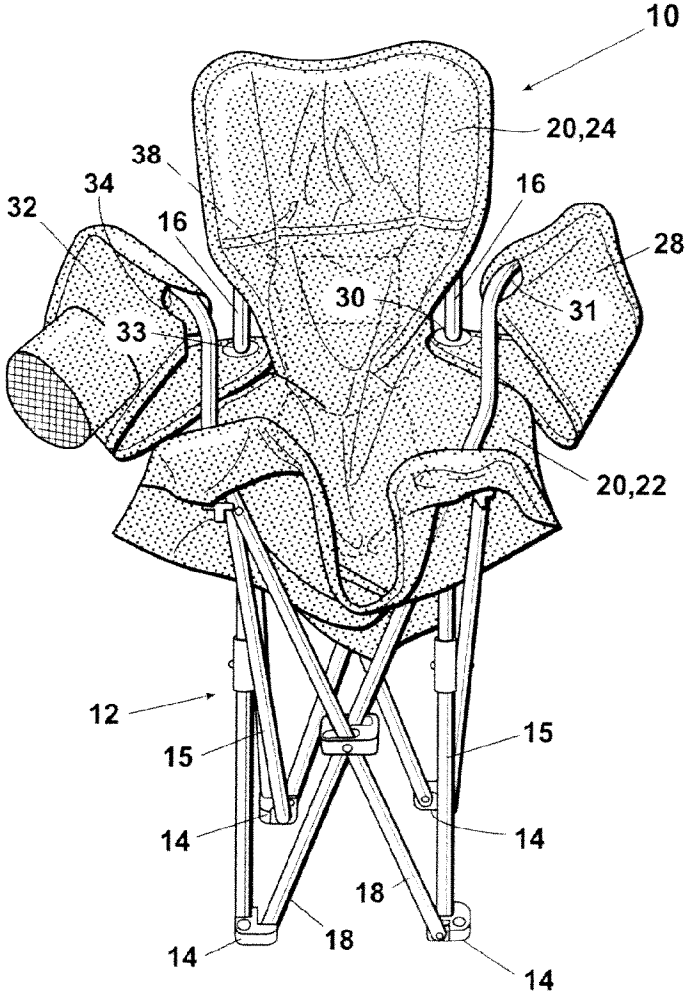
FIG. 6 is a front perspective view of the chair of FIG. 1 shown in a partially collapsed or storage configuration.
Figure 5:
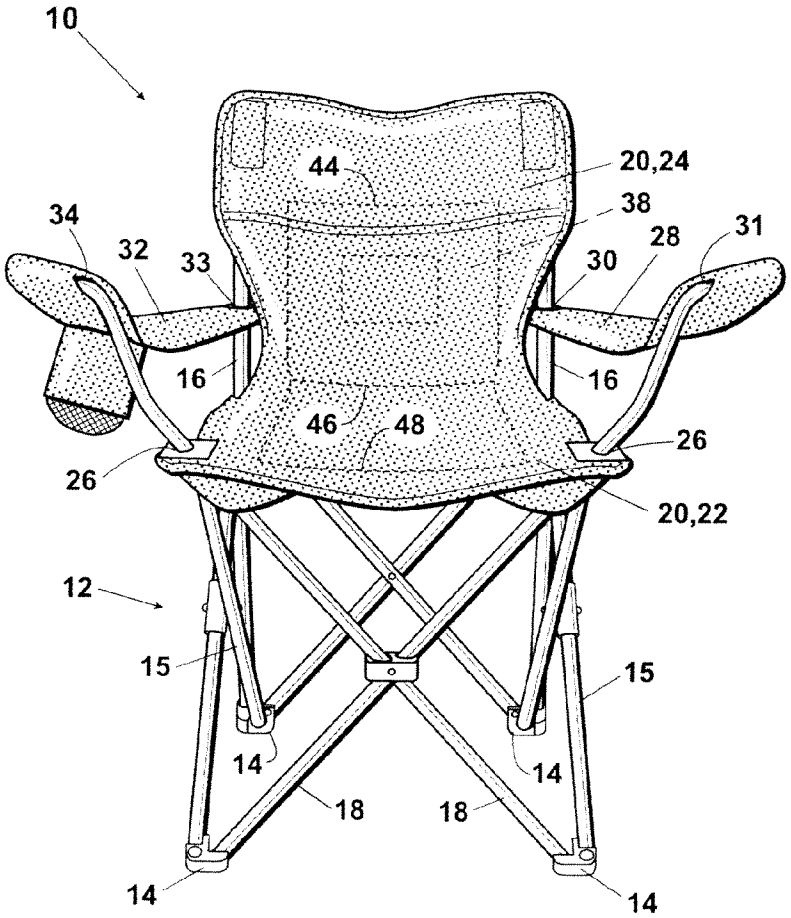
FIG. 5 is a front perspective view of the chair of FIG. 1 shown in an unfolded or use configuration.
Figure 8:
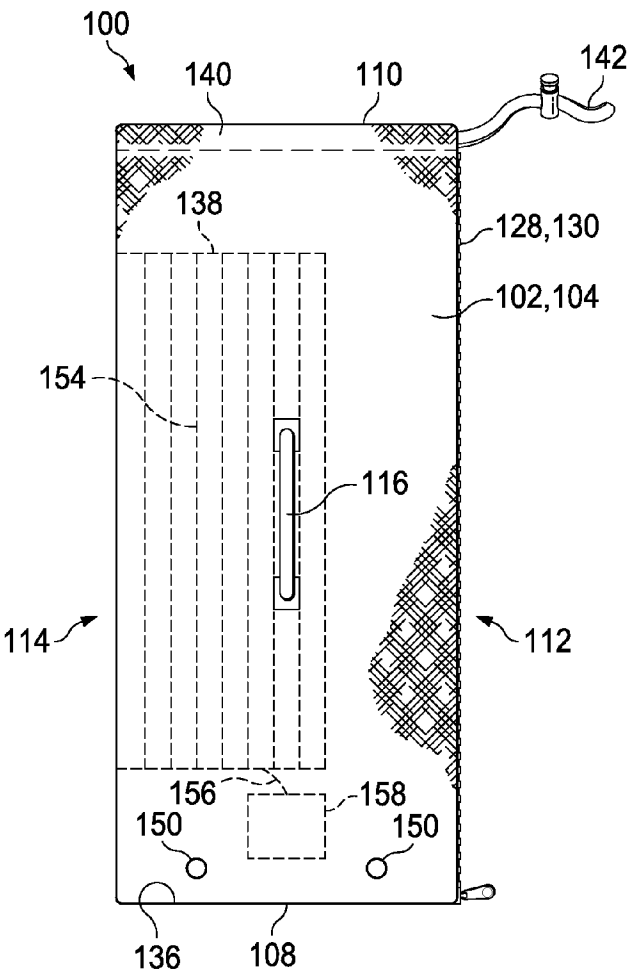
FIG. 8 is a perspective view of the chair bag of FIG. 7 having a closed zippered edge.
Figure 7:
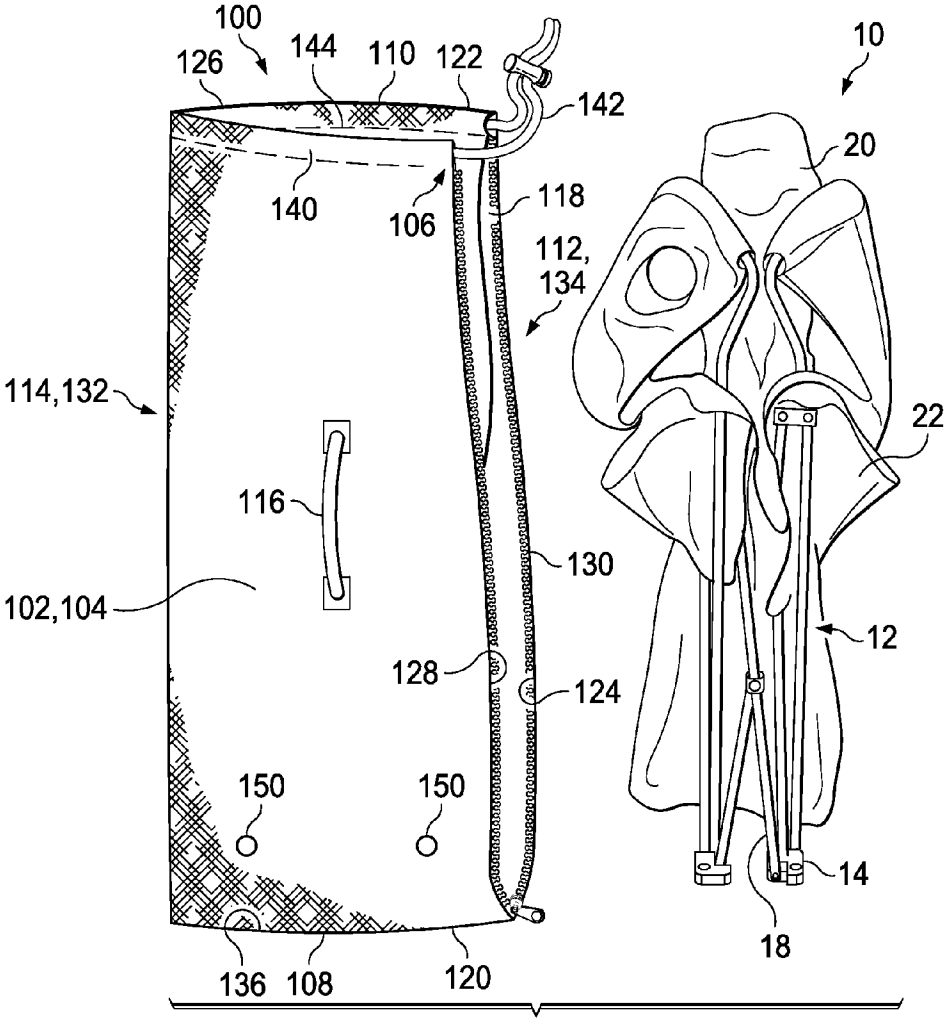
FIG. 7 is a perspective view of a chair bag having an extendable blanket in a stored configuration, an opened zippered edge and showing the chair of FIG. 1 in a collapsed configuration.

Heat is generated by heating elements 40. Heat generated by heating elements 40 passes through human contact sheet 20 for warming a user. As can be seen in FIG. 6, human contact sheet 20 is substantially deformed when frame 12 is collapsed for locating chair 10 in a collapsed configuration for storage and transport. Therefore, as discussed above, heating pad 38, which includes heating element 40 and backing sheet 42, is designed to also be sufficiently flexible so as not to interfere with the ability of chair 10 to collapse, yet still retains the ability to provide heat to a user.

Figure 3:
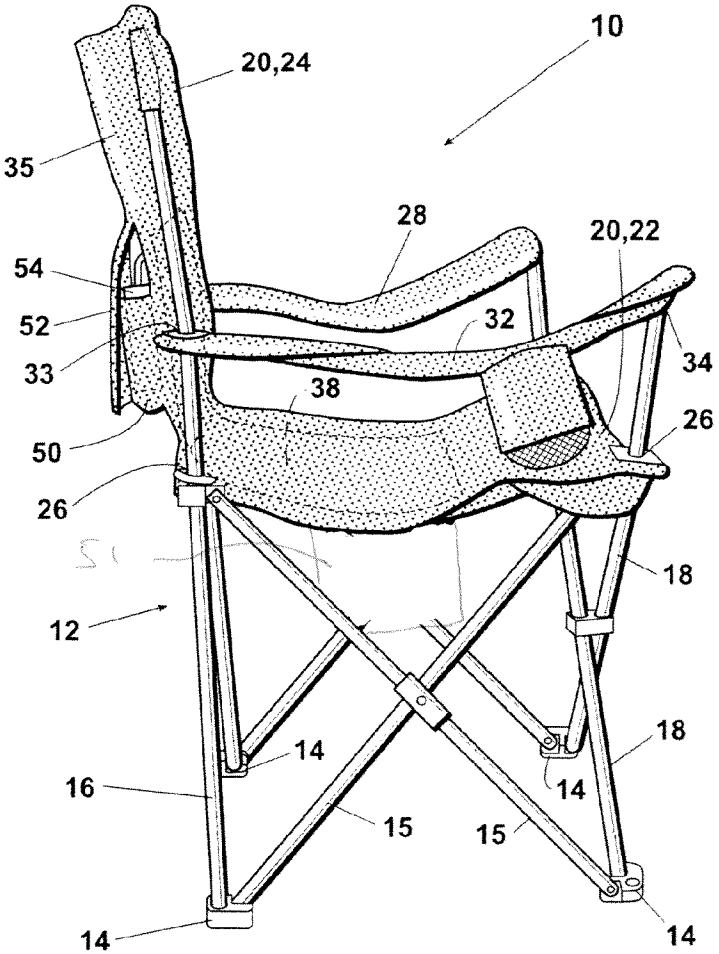
FIG. 3 is side view of the chair of FIG. 1 with the heating pad showing in phantom lines.
Figure 4:
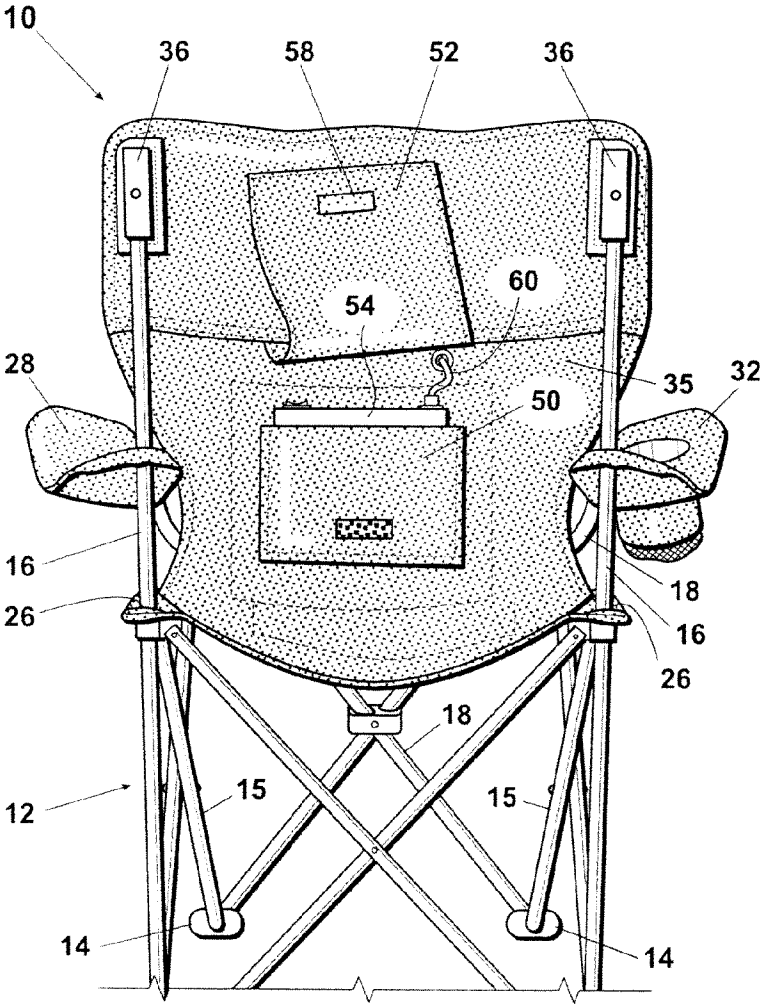
FIG. 4 is a rear view of the chair of FIG. 1 showing a battery enclosing compartment affixed to a fabric chair backing portion and showing the heating pad in phantom lines.

A battery enclosing compartment 50 is affixed to fabric backing portion 35 at a location adjacent to chair back portion 24. Alternatively, a battery enclosing compartment 51 may be affixed to a member affixed to a side of seat portion 22, as shown in FIG. 3. By placing battery enclosing compartment 51 on the side of seat portion 22, a shorter power cord can be employed, i.e., the power cord need only run from compartment 51 to the portion of heating pad 38 adjacent to compartment 51. Battery compartment flap 52 is preferably provided for enclosing battery 54 within battery compartment 50. Flap 52 is preferably provided with fastener 58, such as a hook and loop fastener or other fastening mechanism to secure battery 54 therein.

Figure 2:
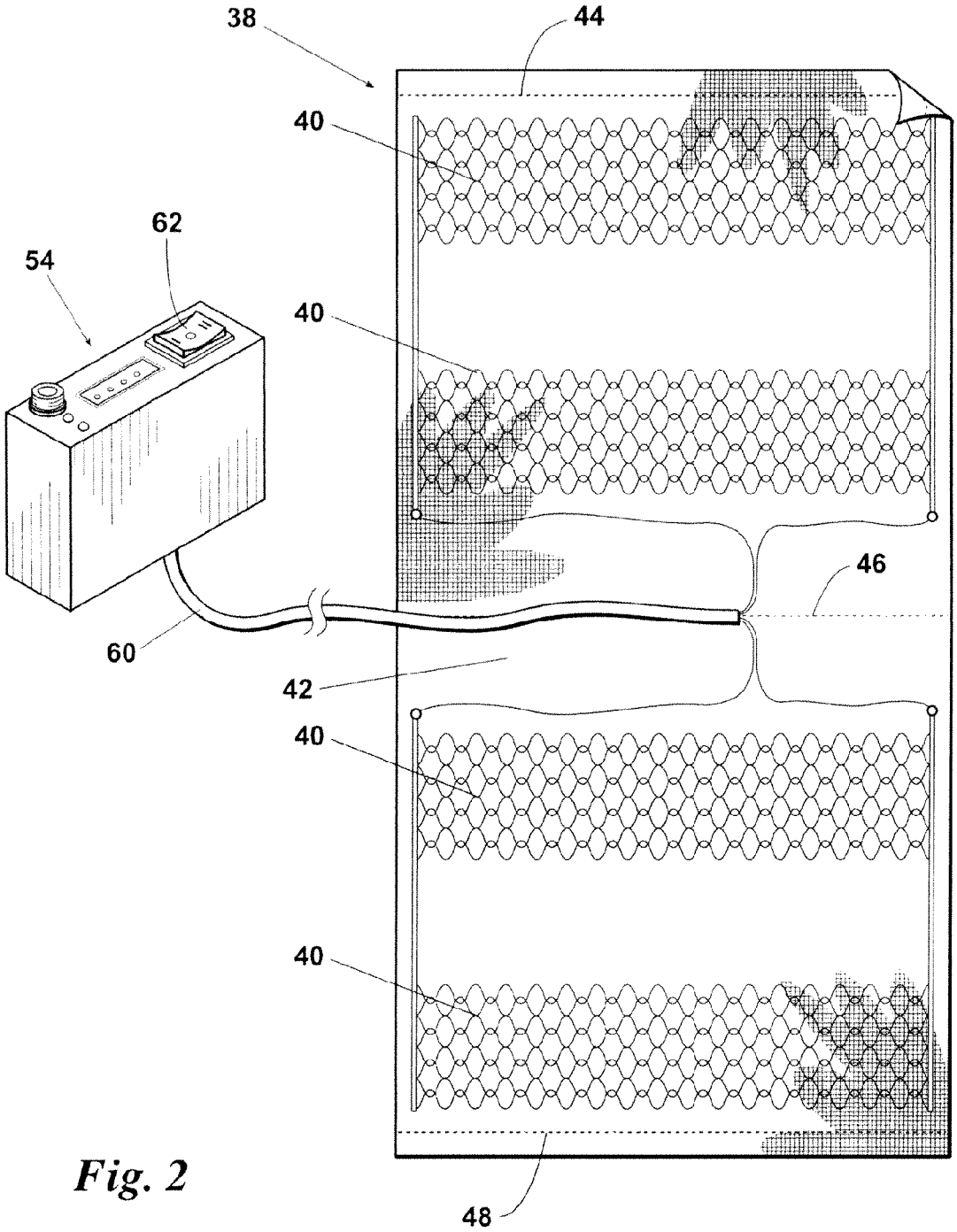
FIG. 2 is an enlarged view showing a top surface of the heating pad and a perspective view of a battery pack for use with the chair of FIG. 1.

Battery 54 may be a rechargeable lithium ion battery, although other types of batteries may also be used. Battery 54 is sized for locating in battery enclosing compartment 50 or 51. Battery 54 is in electrical communication with heating elements 40 via electrical cord 60 (FIG. 2). In one embodiment, battery 54 is provided with a high/low switch 62 (FIG. 2) for providing a selected amount of power to heating elements 40. In another embodiment, battery 54 is a lithium polymer smart battery that is in communication with electronic controls that monitor the power output from battery 54. Preferably, the controls include a setting switch, e.g., enable a user to select one of four settings, thereby maximizing the life of a charge of battery 54.

Collapsible chair 10 of the invention provides the benefit of a flexible, conforming heating pad 38. Such a configuration permits chair 10 to be collapsed into a substantially cylindrical configuration for insertion in a tubular bag for ease of transportation.

Additionally, the flexible conforming nature of heating pad 38 permits maximum contact of heating elements 40 with a user's body as the user weights seat portion 22 and chair back portion 24 of fabric human contact sheet 20. The fabric portions 22, 24 and attached heating pad 38 partially wrap around a seated user for increased heat transfer.

Referring now to FIGS. 7-10, a combination carrying bag and blanket device 100 is provided for use with collapsible chair 10. Carrying bag 100 is made of a shell 102 having an outside 104, an inside 106, a base edge 108, a top edge 110, a first side edge 112, and a second side edge 114. Shell 102 is preferably constructed of a durable fabric such as canvas, nylon, or other suitable materials. Carrying strap 116 is affixed to outside 104 of shell 102.

Liner 118 is affixed to inside 106 of shell 102. Liner 118 also has a base edge 120, a top edge 122, a first edge 124, and a second edge 126. Liner 118 is preferably constructed of a fuzzy insulating material such as wool, fleece, or other blanket-like material.

A first zipper half 128 is affixed to first side edge 112 of shell 102. A second zipper half 130 is also affixed to a first side edge 114 of shell 102. During construction of combo carrying bag 100, a fabric that constitutes shell 102 is folded to mate a first edge and a second edge of shell 102 to form mating edges for receiving first zipper half 128 and second zipper half 130. The folded shell 102 then forms a folded edge 132 and a zippered edge 134. A base seam 136 joins the base edge 108 of the folded shell 102. Base seam 136 runs from folded edge 132 to zippered edge 134. When first zipper half 128 and second zipper half 130 are joined, shell 102 defines a enclosure or cavity 138 for containing collapsible chair 10 when collapsible chair 10 is in a collapsed position. In one embodiment, carrying bag and blanket device 100 is 38.5" from base edge 108 to top edge 110 and is 13.75" from folded edge 132 to zippered edge 124. Although the terms "folded edge" and "zippered edge" are used herein to describe one embodiment, it should be understood that folded edge 132 may be formed by a seam or other attachments and zippered edge 134 may be formed by any selectively attachable mechanism such as Velcro®, snaps, or other fastening means.

A tie cord channel 140 is preferably formed adjacent to top edge 110 of shell 102. Tie cord 142 is received in tie cord channel 140. Tie cord 142 is used to cinch up top edge 110 of combo bag 100 when combo bag 100 is in a closed configuration.

Figure 9:
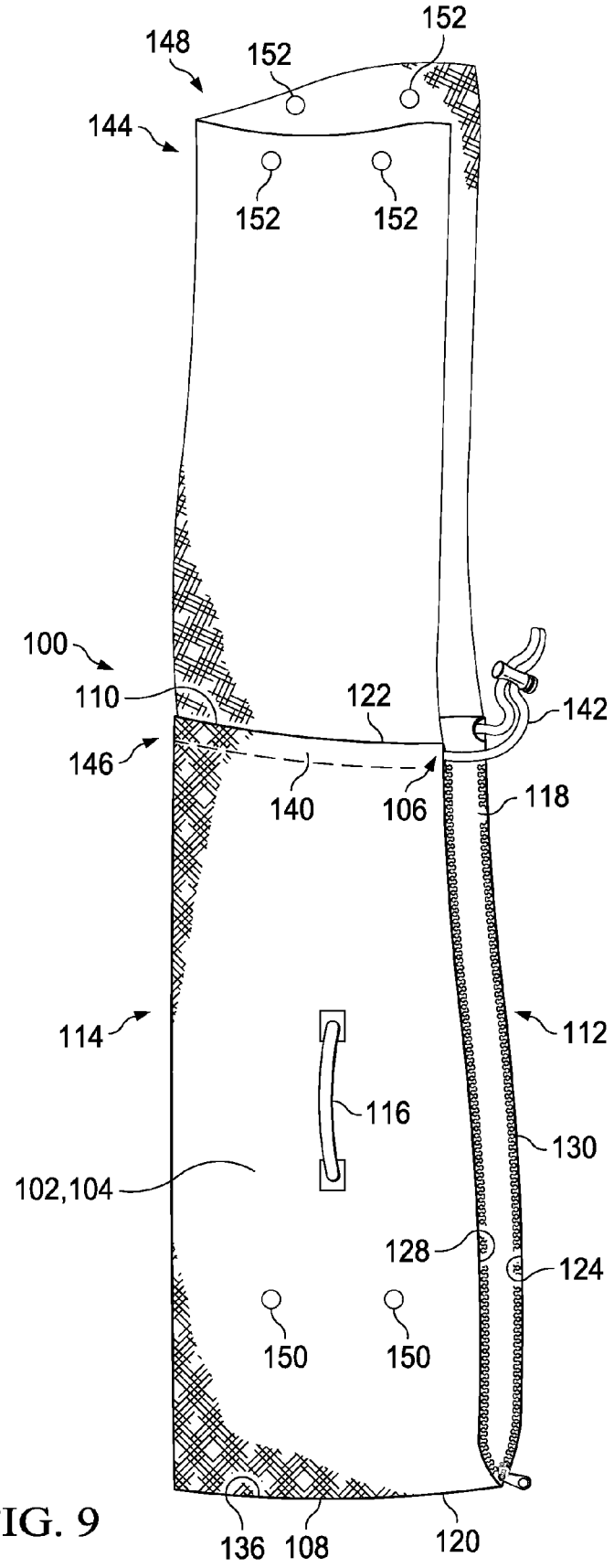
FIG. 9 is a perspective view of the chair bag of FIG. 7 shown in an opened configuration with the interior blanket in an extended position.
Figure 10:
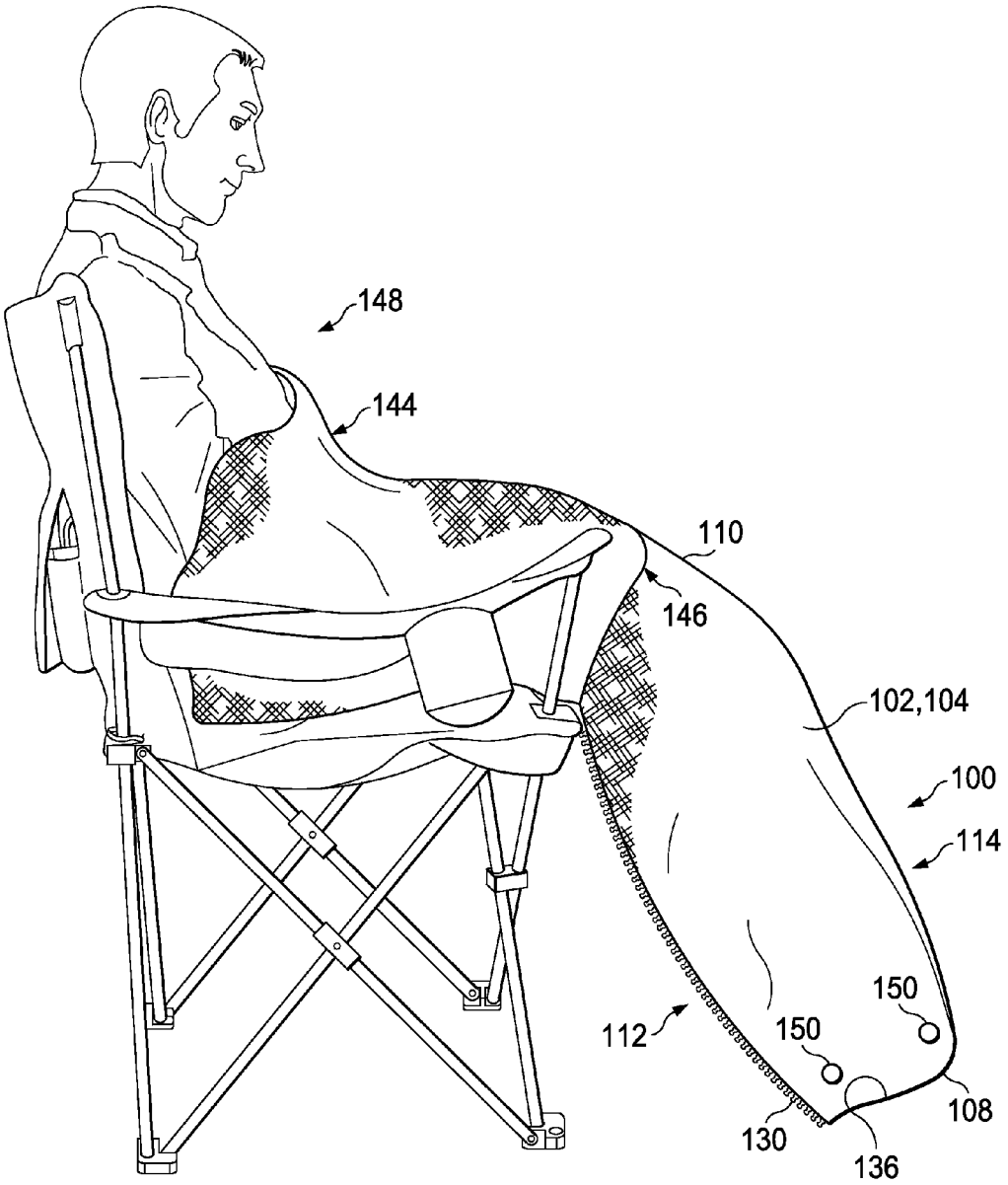
FIG. 10 is a perspective view of the chair bag of FIG. 7 in use to cover the legs of the user with the extended blanket for covering the torso of a user.

An extendable blanket 144 is located within cavity 138 of combo bag 100. Extendable blanket 144 has an attached end 146 and a removable end 148 (FIGS. 9, 10). Attached end 146 is preferably affixed to an inside 106 of combo bag 100. Attached end 146 of extendable blanket 144 may be attached to liner 118. Preferably, attached end 146 of extendable blanket 144 is affixed within combo bag 100 adjacent to top edge 110 of shell 102. When not in use, extendable blanket 144 preferably maintains close contact with liner 118, thereby insuring that cavity 138 remains suitable for receiving collapsible chair 10. Extendable blanket 144 may be extended from combo bag 100, i.e., removed from within cavity 138 to an extended position to provide coverage for a user when a user has positioned the unzipped combo bag 100 over his or her legs and feet as shown in FIG. 10. The resulting configuration is coverage of a user's legs by shell 102 and coverage of a user's torso by extended blanket 144.

In a preferred embodiment, the combo bag 100 has a securing means such as snaps, Velcro®, buttons, or other devices on inside 106, i.e., preferably on an inner surface of liner 118 adjacent to base edge 120 of the liner 118 or base edge 108 of shell 102. The shell attached securing means 150 is for mating engagement with blanket attached securing means 152 located on extendable blanket 144 adjacent to removable end 148 of extendable blanket 144. The engagement of shell attached securing means 150 with blanket attached securing means 152 promotes close engagement of extendable blanket 144 with liner 118 to ease insertion and removal of collapsible chair 10 from combo bag 100.

In one embodiment, a flexible heater pad 154 (FIG. 8) may be positioned between shell 102 and liner 118 to provide heat to a user's legs when combo bag 100 is positioned as shown in FIG. 10, i.e., with first zipper half 128 and second zipper half 130 disengaged to accommodate a user's legs. A power cord 156 is in communication with flexible heater pad 154 on a first end of power cord 156. A second end of power cord 156 communicates with one of chair battery 54 or with shell mounted battery 158 (FIG. 8) for powering flexible heater panel 154. Shell mounted battery 158 may be located between shell 102 and liner 118, inside of liner 118 or mounted external to shell 102 in a pouch or compartment similar to battery enclosing compartment 50.

Therefore, combo bag 100 provides increased functionality as compared to traditional collapsible chair bags by allowing for easy insertion and removal of collapsible chair 10 via selective engagement of zipper halves 128, 130. Additionally, by providing liner 118, a user may sit in collapsible chair 10 and insert his or her legs within the combo bag 100 for warmth and optionally get the benefit of flexible heated panel 154. Further, the user may withdraw extendable blanket 144 from within cavity 138 of combo bag 100 and cover his or her torso.

* * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A carrying bag blanket combination for use with a collapsible chair comprising:

a shell having an outside, and inside, base edge, a top edge, a first edge and a second edge;

a liner inside of said shell;

an opening defined by said shell and said liner for permitting selective access to a space defined by said inside of said shell;

a fastener affixed to said shell adjacent said opening for selectively sealing or opening said opening of said shell;

wherein said shell is sized to receive a collapsed collapsible chair through said opening when said opening is opened;

an extendable blanket having an attached end and a removable end, said attached end attached to one of said liner and said shell adjacent to said top edge of said shell, said extendable blanket for closely contacting said liner when said extendable blanket is in a stored configuration, thereby ensuring that said space defined by said inside of said shell remains suitable for receiving the collapsible chair;

wherein said extendable blanket may be removed from said space defined by said inside of said shell to an extended position for covering a user when said user has inserted his or her legs and feet into the carrying bag;

a shell attached securing means on said inside of said shell adjacent to said base edge of said shell;

a blanket attached securing means adjacent said removable end of said extendable blanket for mating attachment with said shell attached securing means when said extendable blanket is positioned in a stored configuration;

wherein mating engagement of said shell attached securing means and said blanket attached securing means removably affixes said extendable blanket within said space defined by said inside of said shell.

2. The carrying bag according to claim 1 wherein:

said opening is on a said first edge of said shell.

3. The carrying bag according to claim 1 further comprising:

a flexible heater pad between said shell and said liner;

a power cord in communication with said flexible heater pad at a first end and in communication with one of a chair battery or a shell mounted battery at a second end.

4. The carrying bag according to claim 1 further defining:

a tie cord channel adjacent to said top edge of said shell;

a tie cord received in said tie cord channel.

5. A carrying bag blanket combination for use with a collapsible chair comprising:

a shell having an outside, and inside, base edge, a top edge, a first edge and a second edge;

a liner inside of said shell;

an opening defined by said shell and said liner for permitting selective access to a space defined by said inside of said shell;

a fastener affixed to said shell adjacent said opening for selectively sealing or opening said shell;

wherein said shell is sized to receive a collapsed collapsible chair through said opening when said opening is opened;

a flexible heater pad between said shell and said liner;

a power cord in communication with said flexible heater pad at a first end and in communication with one of a chair battery or a shell mounted battery at a second end;

an extendable blanket having an attached end and a removable end, said attached end attached to one of said liner and said shell adjacent to said top edge of said shell, said extendable blanket for closely contacting said liner when said extendable blanket is in a stored configuration, thereby ensuring that said space defined by said inside of said shell remains suitable for receiving the collapsible chair;

wherein said extendable blanket may be removed from said space defined by said inside of said shell to an extended position for covering a user when said user has inserted his or her legs and feet into the carrying bag;

a shell attached securing means on said inside of said shell adjacent to said base edge of said shell;

a blanket attached securing means adjacent said removable end of said extendable blanket for mating attachment with said shell attached securing means when said extendable blanket is positioned in a stored configuration;

wherein mating engagement of said shell attached securing means and said blanket attached securing means removably affixes said extendable blanket within said space defined by said shell.

6. The carrying bag according to claim 5 wherein:

said opening is on a said first edge of said shell.

7. The carrying bag according to claim 5 further defining:

a tie cord channel adjacent to said top edge of said shell;

a tie cord received in said tie cord channel.

* * * * *